United States Patent [19]

Honda et al.

[11] Patent Number: 4,739,734

[45] Date of Patent: Apr. 26, 1988

[54] VALVE TRAIN FOR INTERNAL COMBUSTION ENGINE

[75] Inventors: Shoichi Honda, Nerima; Yoichi Ishida, Niiza; Takashi Kanbe, Urawa, all of Japan

[73] Assignee: Honda Giken Kogyo Kabushiki Kaisha, Japan

[21] Appl. No.: 884,547

[22] Filed: Jul. 11, 1986

[30] Foreign Application Priority Data

| | | | |
|---|---|---|---|
| Jul. 19, 1985 | [JP] | Japan | 60-159979 |
| Jul. 19, 1985 | [JP] | Japan | 60-159978 |
| Dec. 17, 1985 | [JP] | Japan | 60-283641 |

[51] Int. Cl.[4] ..... F01L 1/26

[52] U.S. Cl. ..... 123/90.22; 123/90.43; 123/90.46

[58] Field of Search ..... 123/90.22, 90.23, 90.27, 123/90.43, 90.46, 90.55, 90.58, 196 W; 184/6.5

[56] References Cited

U.S. PATENT DOCUMENTS

| | | | |
|---|---|---|---|
| 3,045,657 | 7/1962 | Sampietro | 123/90.43 |
| 3,170,446 | 2/1965 | Dolza | 123/90.43 |
| 3,376,860 | 4/1968 | Johnson et al. | 123/90.43 |

FOREIGN PATENT DOCUMENTS

| | | | |
|---|---|---|---|
| 1400254 | 7/1975 | United Kingdom | 123/90.44 |
| 0098608 | 7/1980 | Japan | 123/90.43 |
| 0088412 | 5/1983 | Japan | 123/90.15 |
| 0201910 | 11/1984 | Japan | 123/90.16 |

*Primary Examiner*—Charles J. Myhre
*Assistant Examiner*—David A. Okonsky
*Attorney, Agent, or Firm*—Darby & Darby

[57] ABSTRACT

A valve train for an internal combustion engine includes a mounting member mounted on a cylinder head, and a pair of elongated rocker arms interposed between a camshaft and the mounting member. Each rocker arm has opposite first and second sides facing a camshaft and the mounting member, respectively. The rocker arm has opposite ends held respectively against the camshaft and a respective one of intake and exhaust valves at the first side of the rocker arm. A pair of hydraulic tappets are mounted on the mounting member. Each hydraulic tappet includes an axially-extensible elongated body, and a tubular boot of an elastic material mounted around the body to form an oil reservoir therebetween. Each hydraulic tappet has one end held against the second side of a respective one of the rocker arms intermediate the opposite ends of the rocker arm, and the other end of the hydraulic tappet is held by the mounting the against movement away from the rocker arm, whereby upon rotation of the camshaft, each rocker arm is pivotally moved about the one end of the hydraulic tappet for moving a respective one of the intake and exhaust valves.

9 Claims, 7 Drawing Sheets

VALVE TRAIN FOR INTERNAL COMBUSTION ENGINE

BACKGROUND OF THE INVENTION

1. Field of the Invention

This invention relates generally to valve trains for internal combustion engines and more particularly to valve trains incorporating a hydraulic tappet or lash adjuster for automatically keeping a valve clearance to zero.

2. Prior Art

As is well known in the art, a valve train for an internal combustion engine comprises intake and exhaust valves, and a valve-operating mechanism which includes a cam shaft operatively connected via a timing chain to a crankshaft for rotation about an axis thereof, and rocker arms held in engagement respectively with the intake and exhaust valves and operable by the cam shaft for pivotal movement for operating the intake and exhaust valves, respectively.

One example of such conventional valve trains comprises a pair of hydraulic tappets or lash adjusters for intake and exhaust valves, and each hydraulic tappet comprising a hollow cylinder with an open upper end and a plunger received in the cylinder for sliding movement therealong, an upper portion of the plunger extending outwardly from the cylinder. A hydraulic chamber is defined by a lower portion of the cylinder and the bottom of the plunger. A spring acts between the bottom of the cylinder and the bottom of the plunger to urge the plunger upwardly. A tubular boot made of a relatively thin film of rubber encloses the upper portion of the plunger, and the opposite ends of the rubber boot are secured fluid-tight to the upper open end of the cylinder and the upper end of the plunger, respectively, so that the rubber boot and the upper portion of the plunger cooperate with each other to define a chamber therebetween. This chamber serves as an oil reservoir and is in fluid communication with the hydraulic chamber via an oil passageway extending through the plunger and opening to the hydraulic chamber. A check valve element is provided in the hydraulic chamber and normally closes one end of the oil passageway opening to the hydraulic chamber. The upper end of the plunger of each hydraulic tappet is held against a lower surface of the mating rocker arm at one end thereof in such a manner that the rocker arm is pivotal about the upper end of the plunger. An upper end of a stem portion of each of the intake and exhaust valves is held against the lower surface of the mating rocker arm at the other end thereof. The cam shaft is held in contact with the upper surface of the rocker arm intermediate opposite ends thereof. With this construction, when any clearance tends to develop either between the rocker arm and the mating valve or between the rocker arm and the cam shaft due to thermal expansion and wear of these component parts, the plunger is moved outwardly relative to the cylinder under the influence of the spring to increase a length of the hydraulic tappet between the upper end of the plunger and the lower end of the cylinder, thereby preventing such clearance from developing. At this time, upon outward movement of the plunger to axially extend the hydraulic tappet, the check valve element is moved away from the one end of the oil passageway to cause the oil to flow into the hydraulic chamber from the oil passageway, and then the check valve element closes the one end of the oil passageway to prevent the hydraulic tappet from being axially contracted.

This conventional valve train has the following disadvantages:

(i) As described above, the opposite ends of the rocker arm are held in contact with the hydraulic tappet and the valve stem portion, and the cam shaft is held in engagement with the rocker arm intermediate opposite ends thereof. Therefore, when a clearance tends to develop either between the rocker arm and the valve stem portion or between the the rocker arm and the cam shaft, the plunger of the hydraulic tappet is moved outwardly relative to the cylinder by an amount corresponding to the clearance. Thus, the amount of axial extension of the hydraulic tappet is relatively large, which leads to an increased overall size of the engine.

(ii) The hydraulic tappet is disposed below the rocker arm and is disposed near the combustion chamber of the engine, and the boot of the hydraulic tappet is disposed in the vicinity of the combustion chamber above it. Since the boot is made of rubber, it is affected by the heat from the combustion chamber, which leads to a frequent maintenance of the hydraulic tappet.

(iii) Since the hydraulic tappet is disposed below the rocker arm, splashes of oil present in the camshaft chamber tend to impinge on the outer surface of the rubber boot. As a result, there is a possibility that such oil permeates the rubber boot and intrudes into the oil reservoir of the hydraulic tappet. This affects the function of the hydraulic tappet.

(iv) It has also been found through experiments that a small amount of ambient air tends to permeate the thin rubber boot into the oil reservoir, which also affects the function of the hydraulic tappet.

SUMMARY OF THE INVENTION

It is therefore an object of this invention to provide a valve train for an internal combustion engine which will not increase the overall size of the engine, requires less maintenance, and is reliable in operation.

According to the present invention, there is provided a valve train for an internal combustion engine, the internal combustion engine comprising a cylinder head having a pair of intake and exhaust ports, said valve train comprising:

(a) a camshaft housing adapted to be mounted on the cylinder head to define a camshaft chamber;

(b) a pair of intake and exhaust valves mounted on the cylinder head and being movable for closing and opening the intake and exhaust ports, respectively;

(c) a mounting means mounted on the cylinder head and disposed within said camshaft chamber;

(d) a camshaft mounted within said camshaft chamber for rotation about an axis thereof and disposed between the cylinder head and said mounting means;

(e) a pair of elongated rocker arms interposed between said camshaft and said mounting means, each rocker arm having opposite first and second sides facing said camshaft and said mounting means, respectively, said rocker arm having opposite ends held respectively against said camshaft and a respective one of said intake and exhaust valves at said first side of said rocker arm; and (f) a pair of hydraulic tappets mounted on said mounting means, each hydraulic tappet comprising an axially-extensible elongated body, a tubular boot of an elastic material mounted around one end portion of said body to form an oil reservoir therebetween, a hydraulic chamber communicating with said oil reservoir for being supplied with oil therefrom, means urging said body to extend axially, a check valve for normally interrupting the communication between said oil reservoir and said hydraulic chamber to prevent an axial contraction of said elongated body, each hydraulic tappet having one end held against said second side of a respective one of said rocker arms intermediate the opposite ends of said rocker arm, the other end of said hydraulic tappet being held by said mounting means against movement away from said rocker arm, whereby upon rotation of said camshaft, each rocker arm is pivotally moved about said one end of said hydraulic tappet for moving a respective one of said intake and exhaust valves.

DESCRIPTION OF THE PREFERRED EMBODIMENTS OF THE INVENTION

Figure 1:
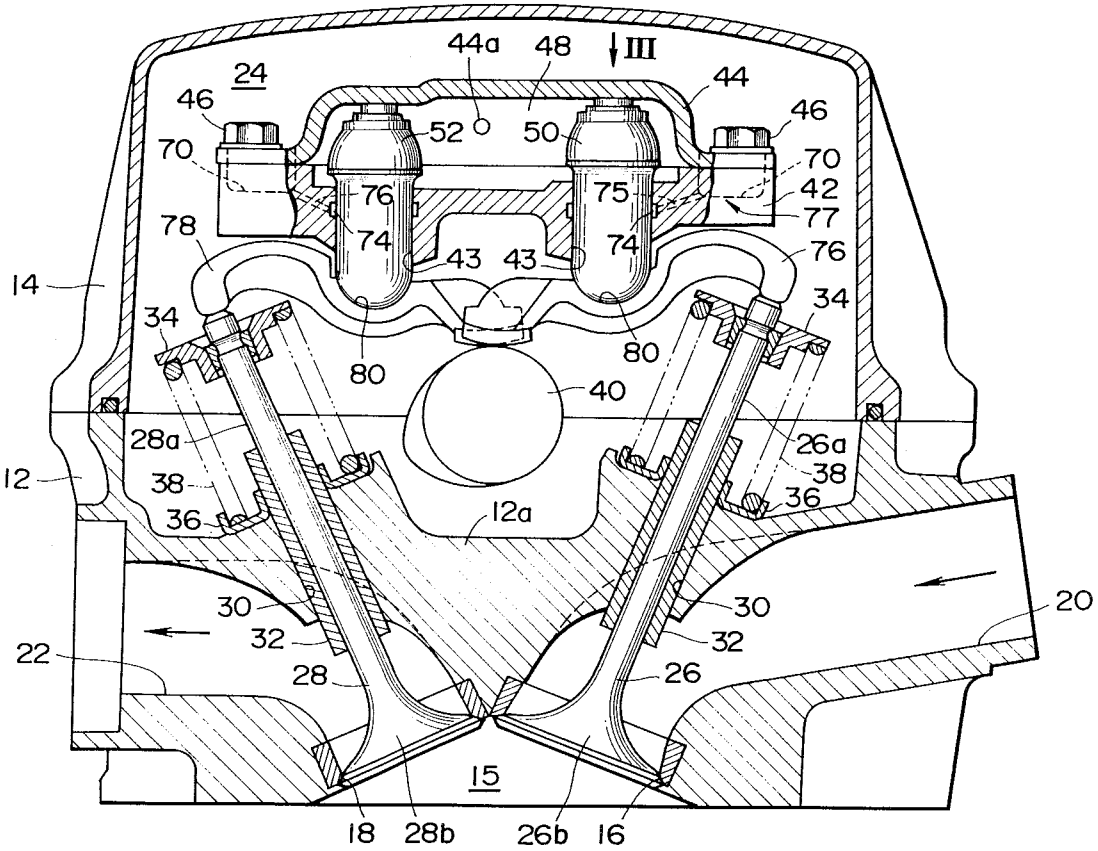
FIG. 1 is a cross-sectional view of a portion of an internal combustion engine incorporating a valve train provided in accordance with the present invention.

The invention will now be described with reference to the drawings in which like reference numerals denote corresponding parts in several views.

A four-cycle internal combustion engine of the vertical type shown in FIG. 1 comprises a cylinder block (not shown), a cylinder head 12 mounted on the cylinder block, and a camshaft housing 14 of an inverted cup-shape mounted on the cylinder head 12. Although not shown in the drawings, a piston is received in a cylinder formed in the cylinder block for reciprocal movement therealong in the well known manner. A combustion chamber 15 is defined by the cylinder head 12 and the cylinder block. The cylinder head 12 has a pair of intake and exhaust ports 16 and 18 formed in an upper wall thereof, and also has a pair of intake and exhaust passages 20 and 22 opening to the intake and exhaust ports 16 and 18, respectively.

A valve train for the engine will now be described. The camshaft housing 14 cooperates with the cylinder head 12 to define a camshaft chamber 24. A pair of intake and exhaust valves 26 and 28 are mounted on the cylinder head 12 for closing and opening the intake and exhaust ports 16 and 18, respectively. The intake and exhaust valves 26 and 28 have respective stem portions **26*a* and 28*a* and respective valve portions 26*b* and 28*b* formed respectively on one ends of the stem portions 26*a* and 28*a*. A pair of elongated holes 30 are formed through an upper wall 12*a* of the cylinder head 12, and a pair of sleeves 32 are snugly fitted respectively in the holes 30 and fixed thereto. A retainer ring 34 is fixedly secured to an upper end of the stem portion 26*a*, 28*a* of each of the intake and exhaust valves 26 and 28. A washer 36 is fitted on each sleeve 32 and rests on the upper surface of the cylinder head 12. A coil spring 38 is wound around the stem portion 26*a*, 28*a* of each of the intake and exhaust valves 26 and 28 and acts between the retainer ring 34 and the washer 36 to normally urge the valve portion 26*b*, 28*b* in a direction to close a respective one of the intake and exhaust ports 16 and 18**.

A camshaft 40 is mounted within the camshaft chamber 24 for rotation about a longitudinal axis of the camshaft, the camshaft 40 being disposed above the combustion chamber 15 and disposed between the intake and exhaust valves 26 and 28. Although not shown in the drawings, the camshaft 40 is operatively connected to a crankshaft via a timing chain for being driven for rotation in the well known manner. The speed of rotation of the camshaft 40 is half the speed of rotation of the crankshaft. A mounting block or member 42 is accommodated within the camshaft chamber 24 and fixed to the cylinder head 12, the mounting block 42 extending substantially perpendicular to an axis of the combustion chamber 15 and hence an axis of the cylinder. The mounting block 42 has a pair of spaced apertures 43 formed therethrough. A cover member 44 of an inverted dish-shape is secured by bolts 46 to the mounting block 42 to define therewith an enclosed space or chamber 48. The cover member 44 has a vent aperture **44*a* formed therethrough for communicating the chamber 48 with the camshaft chamber 24**.

Figure 2:
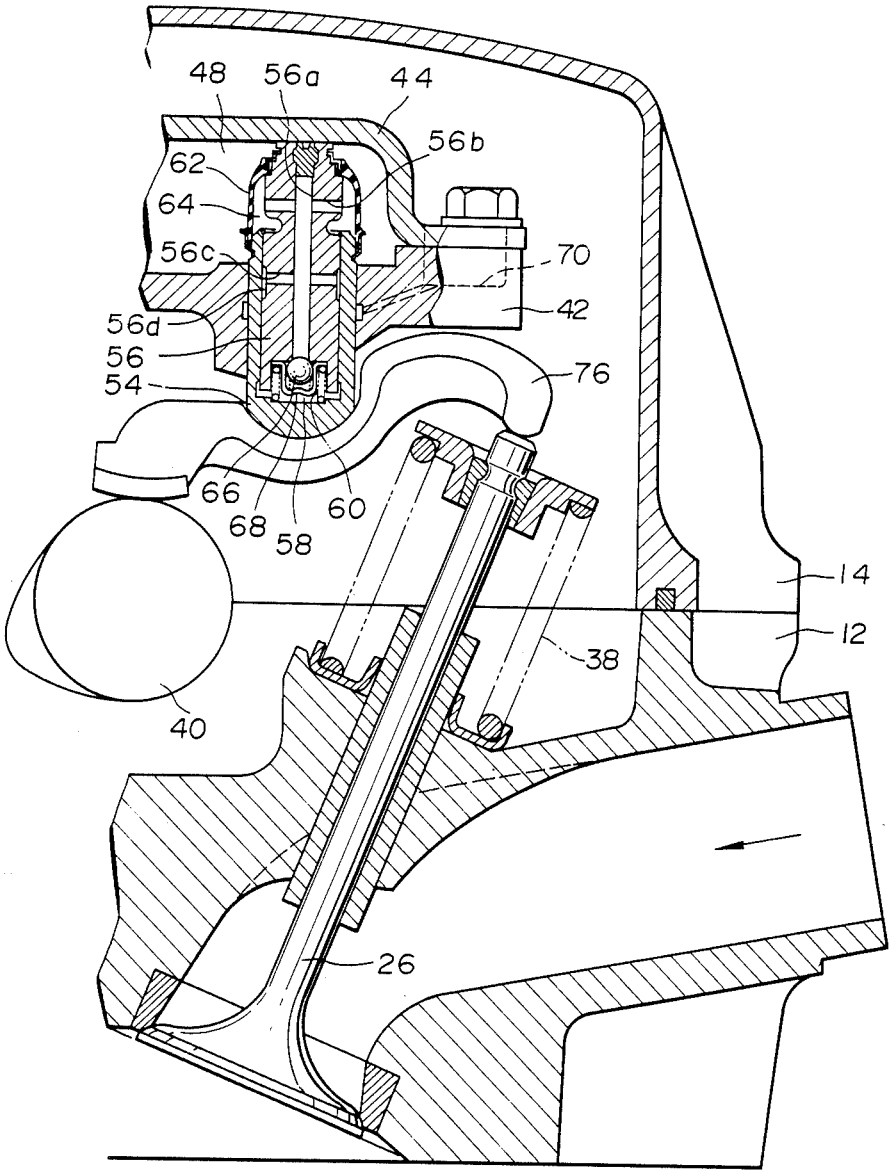
FIG. 2 is a fragmentary cross-section view of the engine in an enlarged scale.

A pair of hydraulic tappets or lash adjusters 50 and 52 are mounted on the mounting block 42. As best shown in FIG. 2, each of the hydraulic tappets 50 and 52 comprises a hollow cylinder 54 having an open top and a closed bottom, and a plunger 56 received in the cylinder 54 for sliding movement therealong. An upper portion of the plunger 56 extends outwardly from the cylinder 54. A hydraulic chamber 58 is defined by a lower portion of the cylinder 54 and a recessed bottom of the plunger 56. A coil spring 60 acts between the bottom of the cylinder 54 and the bottom of the plunger 56 to urge the plunger 56 upwardly. Thus, the cylinder 54 and the plunger 56 cooperate with each other to provide an axially extensible body of the hydraulic tappet 50, 52. A tubular boot 62, made of a thin film of an elastic material such as rubber, encloses the upper portion of the plunger 56, and the opposite ends of the boot 62 are secured fluid-tight to the upper open end of the cylinder 54 and the upper end of the plunger 56, respectively, so that the boot 62 and the upper portion of the plunger 56 cooperate with each other to define an annular chamber 64 therebetween. The annular chamber 64 serves as an oil reservoir and holds oil therein. The plunger 56 has an axial passageway **56*a* formed therethrough and a pair of first and second transverse passageways 56*b* and 56*c* formed therethrough and spaced along the axis of the plunger 56. The first transverse passageway 56*b* open at opposite ends to the annular chamber 64. The second transverse passageway 56*c* leads to a peripheral groove 56*d* formed in the outer peripheral surface of the plunger 56 to make smooth the sliding movement of the plunger 56 relative to the cylinder 54. The first and second transverse passageways 56***b* and 56*c* communicate with the axial passageway 56*a*. The oil reservoir 64 serves as an oil reservoir and is in fluid communication with the hydraulic chamber 58 via the first transverse passageway 56*b* and the axial passageway 56*a*. A check valve element 66 in the form of a ball is provided in the hydraulic chamber 58 and normally closes a valve port defined by one end of the axial passageway 56*a* opening to the hydraulic chamber 58. A valve cage 68 is mounted within the hydraulic chamber 58 and is urged against the bottom of the plunger 56 by the oil spring 64 and receives the valve element 66 therein. The valve element 66 and the bottom of the plunger 56 having the valve port constitute a check valve.

Figure 3:
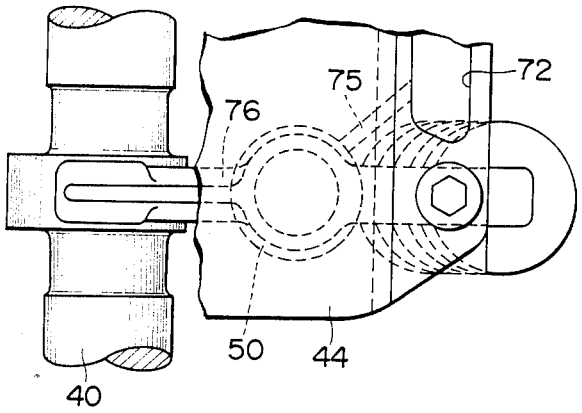
FIG. 3 is a fragmentary view as viewed in a direction of an arrow III of FIG. 1.

The cylinders 54 of the hydraulic tappets 50 and 52 are fitted in and extended through the apertures 43 of the mounting block 42, respectively, for sliding movement along the respective longitudinal axes of the tappets 50 and 52, the longitudinal axes of the tappets 50 and 52 being disposed substantially parallel to the axis of the combustion chamber 15. A pair of oil wells 70 are formed in an upper surface of the mounting block 42 at opposite ends thereof. An opening 72 (FIG. 3) is formed through the cover member 44 and disposed in vertical registry with the oil wells 70. Part of oil present in the camshaft chamber 24 collects in the oil wells 70 through the openings 72. An annular groove 74 is formed in the surface defining each aperture 43 of the mounting block 42, and a pair of bores 75 are formed in the mounting block 42 and communicate the oil wells 70 with the respective grooves 74 so as to lubricate the surfaces of the respective apertures 43 with which the hydraulic tappets 50 and 52 are disposed in sliding contact, respectively. Thus, the oil well 70, the opening 72, the annular groove 74 and the bore 75 constitute a lubricating means 77.

A pair of elongated rocker arms 76 and 78 are mounted within the camshaft chamber 24 and are disposed between the camshaft 40 and the mounting block 42. Each of the rocker arms 76 and 78 has a semi-circular socket or recess 80 generally centrally of a length thereof. The cylinder 54 of each of the hydraulic tappets 50 and 52 has a semi-circular lower end. One end of the rocker arm 76 is held against the upper end of the stem portion 26*a* of the intake valve 26 at a lower surface thereof while the other end is held against the camshaft 40 at the lower surface thereof. Similarly, one end of the rocker arm 78 is held against the upper end of the stem portion 28*a* of the exhaust valve 28 at a lower surface thereof while the other end is held against the camshaft 40 at the lower surface thereof. The semi-circular lower end of the cylinder 54 of each of the hydraulic tappets 50 and 52 is received in a respective one of the semi-circular sockets 80 of the rocker arms 76 and 78. The cover plate 44 serves as abutment means against which the upper end of the plunger 56 is held. Thus, each of the rocker arms 76 and 78 is supported by the valve 26, 28, the hydraulic tappet 50, 52, and the camshaft 40. And, each of the rocker arms 76 and 78 is pivotal about the semi-circular lower end of the cylinder 54.

In operation, upon rotation of the camshaft 40, the rocker arms 76 and 78 are pivotally moved about the respective semi-circular lower ends of the cylinders 54 of the hydraulic tappets 50 and 52, so that the intake and exhaust valves 26 and 28 are moved downwardly against the bias of the respective return springs 38, thereby opening the intake and exhaust ports 16 and 18 in the well known manner.

When any clearance tends to develop either between the rocker arm 76, 78 and the mating valve 26, 28 or between the rocker arm 76, 78 and the cam shaft 40 due to thermal expansion and wear of these component parts, the cylinder 54 is moved downwardly relative to the plunger 56 under the influence of the spring 60 since the upper end of the plunger 56 is held against the cover member 44, thereby increasing the length of the hydraulic tappet 50, 52 to prevent such clearance from developing. At this time, upon downward movement of the cylinder 54 to axially extend the hydraulic tappet, the check valve element 66 is moved away from the valve port or one end of the axial passageway 56*a* to cause the oil to flow into the hydraulic chamber 58 from the passageway 56*a*, and then the check valve element 66 again closes the valve port so as to prevent the cylinder 54 from moving upwardly relative to the plunger 56. Thus, the hydraulic tappet or lash adjuster 50, 52 is designed to be automatically extended axially to keep a valve clearance to zero. And, even if the hydraulic tappet is subjected to a substantial axial compressive force, its length will not be shortened. When the cylinder 54 is downwardly moved axially relative to the plunger 56 to cause the oil to flow into the hydraulic chamber 58 to increase the volume of the chamber 58, the elastic boot 62 is deformed or contracted to decrease the volume of the oil reservoir 64 correspondingly.

As described above, the hydraulic tappet 50, 52 is held against the upper surfaces of the rocker arm 76, 78, and the elastic boot 62 is provided on the upper portion of the hydraulic tappet. Therefore, the boot 62, which is liable to damage by heat, is spaced sufficiently far from the combustion chamber 15 that the boot 62 is less affected by the heat from the combustion chamber 15, thereby enhancing the durability of the boot 62 and hence the durability of the hydraulic tappet. In addition, the hydraulic tappet 50, 52 is held against the upper surface of the rocker arm 76, 78 intermediate the opposite ends thereof, that is, generally centrally of the length of the rocker arm. Therefore, if any valve clearance tends to develop in the valve train of this embodiment, the amount of axial extension of the hydraulic tappet 50, 52, that is, the axial outward movement of the cylinder 54 relative to the plunger 56, is about half of that of the conventional hydraulic tappet mentioned above. Therefore, the operation of the hydraulic tappet 50, 52 is more stable in operation and is more durable. In addition, the overall size of the engine can be compact.

Further, since the elastic boot 62 of the hydraulic tappet 50, 52 is disposed within the chamber 48 and therefore is isolated from the camshaft chamber 24, splashes of the oil lubricating the component parts in the camshaft chamber 24, such as the camshaft 40 and the rocker arms 76 and 78, are prevented from reaching the boot 62. Thus, such oil will not intrude into the oil reservoir 64 through the boot 64.

Further, by virtue of the provision of the lubricating means 77, each hydraulic tappet 50, 52 is slidingly moved along the aperture 43 of the mounting block 42 quite smoothly.

Figure 4:
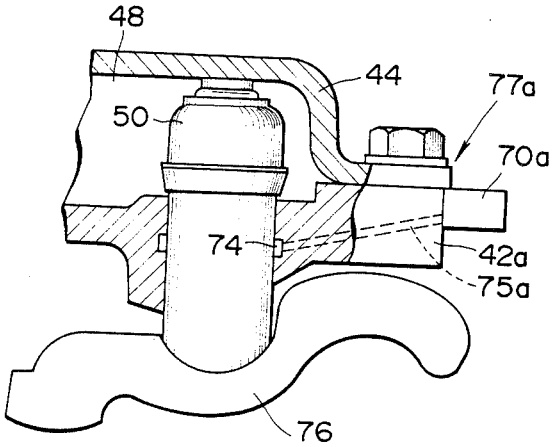
FIG. 4 is a fragmentary view of a modified valve train, showing a modified lubricating means.

FIG. 4 shows a portion of a modified valve train which differs from the valve train of FIG. 1 in that there is provided a modified lubricating means 77*a* in which the oil well 70 is replaced by an oil well 70*a* defined by a square box with an open top, and that an oil feed bore 75*a* extends through a mounting block 42*a* and communicates at opposite ends thereof with the annular groove 74 and the box-like oil well 70*a*. In this embodiment, the opening 72 is omitted.

Figure 5:
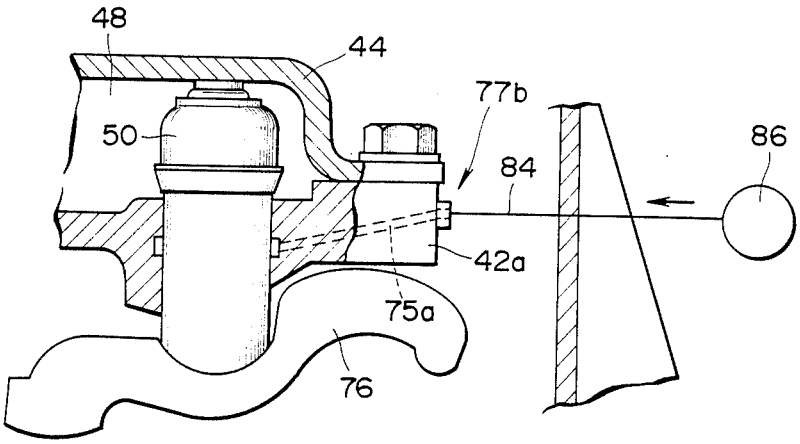
FIG. 5 is a view similar to FIG. 4 but showing another modified lubricating means.

FIG. 5 shows another modified lubricating means 77*b* which differs from the lubricating means 77*a* of FIG. 4 in that the box-like oil well 70*a* is omitted and that a lubricating oil is fed to the annular groove 74 via an oil feed line 84 and the bore 75*a* from an oil pump 86 disposed exteriorly of the camshaft chamber 24. In this embodiment, the need for an oil well is obviated.

Figure 6:
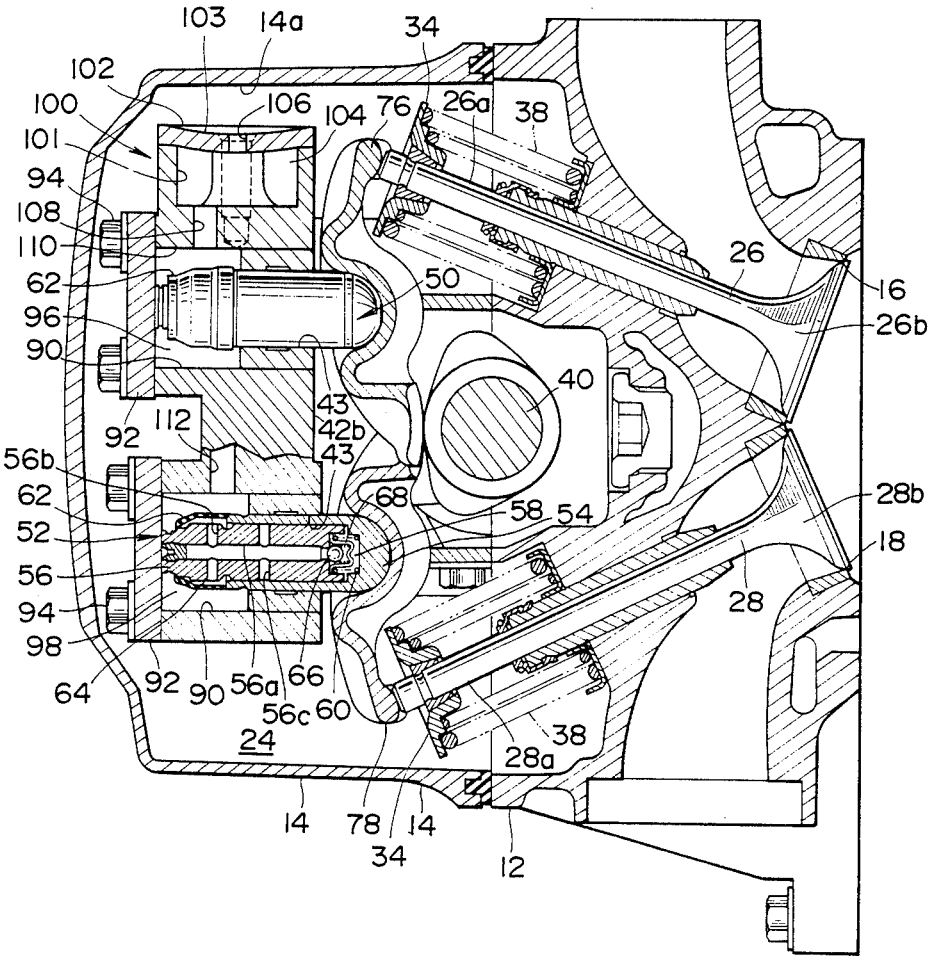
FIG. 6 is a cross-sectional view of a portion of an engine of the horizontal type incorporating a further modified valve train.

FIG. 6 shows a further modified valve train applied to an internal combustion engine of the horizontal type. Apart from the horizontal disposition of the component parts, the valve train in this embodiment differs from the valve train of FIG. 1 in that a modified mounting block 42*b* is provided. The mounting block 42*b* disposed vertically has a pair of vertically spaced recesses 90 opening away from the rocker arms 76 and 78. A pair of cover plates 92 are secured by bolts 94 to the mounting block 42*b* to cover the openings of the recesses 90, respectively, so that the recesses 90 cooperate respectively with the cover members 92 to define a pair of first and second oil chambers 96 and 98 in which oil is filled. A pair of apertures 43 and 43 are formed through the mounting block 42*b*, and the cylinders 54 of the hydraulic tappets 50 and 52 are extended through the apertures 43, respectively, for sliding movement along the axes of the tappets 50 and 52, as described above for the embodiment of FIG. 1. The elastic boots 62 of the hydraulic tappets 50 and 52 are disposed within the first and second oil chambers 96 and 98, respectively. The one ends of the plungers 56 of the hydraulic tappets 50 and 52 are held against the cover plates 92, respectively.

An oil supply means is provided for supplying oil to the oil chambers 96 and 98. The oil supply means comprises a degassing means 100 for degassing the oil to be fed to the first and second oil chambers 96 and 98. More specifically, the mounting block 42*b* has an upwardly-opening recess or hollow portion 101 at an upper portion thereof and disposed adjacent to the first oil chamber 96. A lid 102 is attached to the opening of the recess 101, so that a degassing chamber 104 is defined by the recess 101 and the lid 102. The lid 102 has a dish-like upper surface 103 and an inlet aperture 106 formed therethrough and communicating the camshaft chamber 24 with the degassing chamber 104. The degassing chamber 104 communicates with the first oil chamber 96 via a passageway 108 formed through a wall 110 isolating the two chambers 104 and 96 from each other. The first oil chamber 96 communicates with the second oil chamber 98 via a passageway 112 formed in the mounting block 42*b*.

The elastic boot 62 of each hydraulic tappet 50, 52 is accommodated within the oil chamber 96, 98 in which the oil is filled, so that the boot 62 is completely isolated from the ambient air, thereby positively preventing the air from permeating the boot 62 into the oil reservoir 64.

Oil present in the camshaft chamber 24 deposits on that portion 14*a* of the inner surface of the camshaft housing 14 disposed in opposed relation to the aperture 106 of the lid 102 is caused to drop by gravity to the dish-like upper surface 103 of the lid 102 and is introduced into the degassing chamber 104 through the aperture 106 to replenish the first and second oil chambers 96 and 98 with the oil. Thus, the lid 102 having the aperture 106, the degassing chamber 104, and the passageways 108 and 112 constitute the oil supply means for supplying the oil chambers 96 and 98 with the oil. The oil in the first and second oil chambers 96 and 98 tends to leak along the cylinders 54 of the hydraulic tappets 50 and 52, and the oil supply means compensates for this oil leakage.

The oil introduced through the aperture 106 into the degassing chamber 104 contains a considerable amount of air in the form of bubbles. The degassing chamber 104 serves to arrest such air bubbles. And, the oil, fed from the degassing chamber 104 to the first oil chamber 96 via the passageway 108, is degassed to a satisfactory level, so that the air is more positively prevented from permeating the boot 62 of each hydraulic tappet 50, 52.

It is preferred that each of the passageway 108 should be as narrow as possible, so that it takes an adequate time for the oil in the degassing chamber 104 to reach the first oil chamber 96 via the passageway 108 to enhance the degassing effect.

Figure 7:
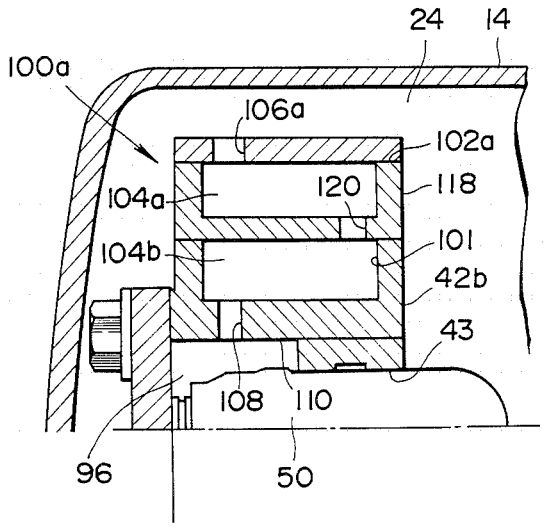
FIG. 7 is a fragmentary view, showing a modified degassing means.

FIG. 7 shows a modified degassing means 100*a* which differs from the degassing means 100 of FIG. 6 in that the degassing means 100*a* has a pair of first and second degassing chambers 104*a* and 104*b*. More specifically, a box 118 with an open top is mounted on the upper end of the mounting block 42*b* to cover an open top of a recess 101, and a lid 102*a* is mounted on the upper end of the box 118 to cover the open top thereof. Thus, the recess 101 and the box 118 define a hollow portion divided into the pair of vertically-spaced first and second degassing chambers 104*a*. The lid 102*a* has an aperture 106*b*, and the bottom wall of the box 118 has a communication aperture 120. Also, a passageway 108 is formed through a wall 110 as described above for the preceding embodiment. The aperture 106*a*, the aperture 120 and the passageway 108 are staggered in a vertical direction so as to increase a length of a path of flow of the oil from the aperture 106 to the first oil chamber 96. With this arrangement, the oil must pass through the aperture 106*a*, the first degassing chamber 104*a*, the aperture 120, the second degassing chamber 104*b* and the passageway 108 in order to reach the first oil chamber 96. In addition, as described above, the aperture 106*a*, the aperture 120 and the passageway 108 are disposed in staggered relation to provide a path of flow of the oil. Therefore, it takes the oil, introduced through the aperture 120, a longer time to reach the first oil chamber 96, and hence the oil is degassed to a satisfactory level before it reaches the first oil chamber 96. This more positively prevents the air from permeating the boot 62 into the oil reservoir 64 of the hydraulic tappet 50, 52.

Figure 8:
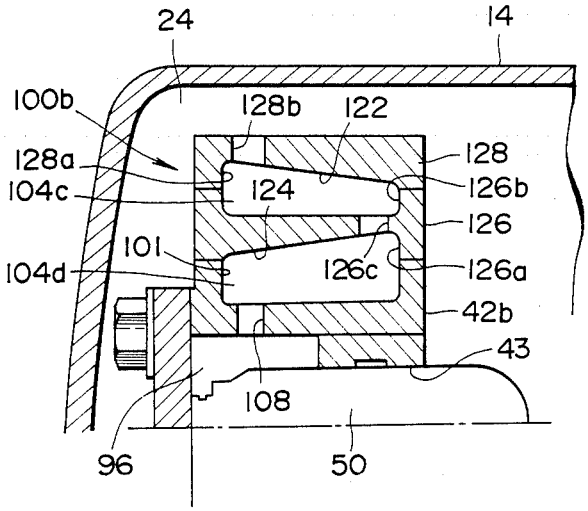
FIG. 8 a view similar to FIG. 7 but showing another modified degassing means.

FIG. 8 shows another modified degassing means 100*b* which differs from the degassing means 100*a* of FIG. 7 in that the degassing means 100*b* has a pair of first and second degassing chambers 104*c* and 104*d* have slanting upper surfaces 122 and 124, respectively. More specifically, a first structural member 126 has a pair of recesses 126*a* and 126*b* at opposite sides thereof, and is mounted on an upper end of the mounting block 42*b* to close an open top of the recess 101 so that the recess 101 and the recess 126*a* jointly provide the second chamber 104*d*. A second structure member 128 has a recess 128*a* at one side thereof, and is mounted on the upper end of the first structural member 126 so that the recess 126*b* and the recess 128*a* jointly provide the first degassing chamber 104*c*. The second structural member 128 has an aperture 128*b* , and the first structural member 126 has an aperture 126*c*. The aperture 128*b*, the aperture 126*c* and the passageway 108 are disposed in staggered relation as described above for the preceding embodiment. The first degassing chamber 104c has the upper surface 122 slanting upwardly toward the aperture 128b, and the second degassing chamber has the upper surface 124 slanting upwardly toward the aperture 126c. With this arrangement, the air bubbles in the oil in the second degassing chamber 104d are moved along the slanting upper surface 124 toward the aperture 126c and are discharged therefrom into the first degassing chamber 104c. Similarly, the air bubbles in the oil in the first degassing chamber 104c are moved along the upper slanting surface 122 toward the aperture 128b and are discharged therefrom. Thus, the oil in the first and second degassing chambers 104c and 104d are degassed more quickly.

Figure 9:
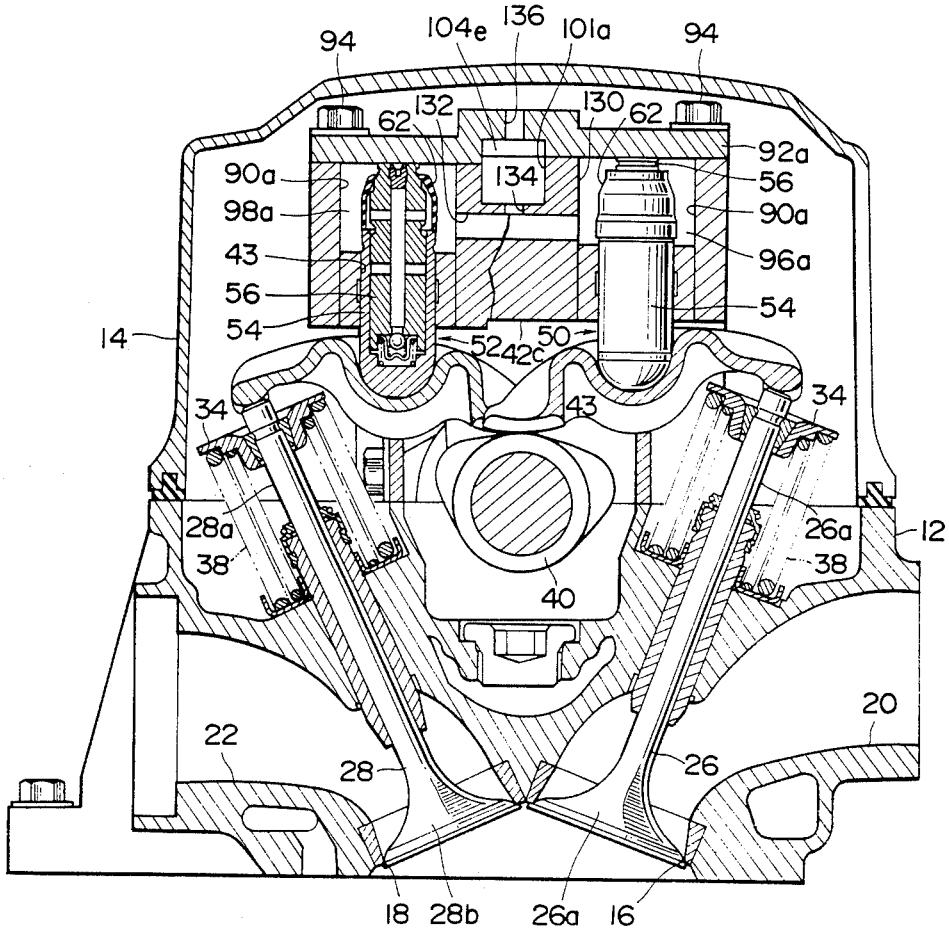
FIG. 9 is a cross-sectional view of an engine of the vertical type incorporating a further modified valve train.

FIG. 9 shows shows a further modified valve train applied to an internal combustion engine of the vertical type. Apart from the vertical disposition of the component parts, the valve train in this embodiment differs from the valve train of FIG. 6 in that a modified mounting block 42c is provided. In this embodiment, the mounting block 42c has a pair of upwardly-opening recesses 90a spaced horizontally from each other by a central wall 130. A cover plate 92a is secured by bolts 94 to an upper end of the mounting block 42c to cover the openings of the recesses 90a so that the recesses 90a cooperate with the cover members 92 to define a pair of first and second oil chambers 96a and 98a in which oil is filled. A pair of apertures 43 and 43 are formed through the mounting block 42c, and the cylinders 54 of the hydraulic tappets 50 and 52 are extended through the apertures 43, respectively, for sliding movement along the axes of the tappets 50 and 52, as described above for the embodiment of FIG. 1. The elastic boots 62 of the hydraulic tappets 50 and 52 are disposed within the first and second oil chambers 96a and 98a, respectively, as described above for the embodiment of FIG. 6. The one ends of the plungers 56 of the hydraulic tappets 50 and 52 are held against the cover plate 92a, respectively. In this embodiment, an upwardly-opening recess or hollow portion 101a is formed in the central wall 130, and the recess 101a is closed by the cover plate 92a, so that the recess 101a and the cover plate 92a jointly define a degassing chamber 104e. The first and second oil chambers 96a and 98a are communicated with each other through a passageway 132 extending horizontally through the central wall 130. The degassing chamber 104e is communicated with the passageway 132 through a port 134, the passageway 132 being disposed at a level lower than the degassing chamber 104e. The cover plate 92a has a central aperture 136 formed therethrough through which the oil is introduced into the degassing chamber 104e. Since the degassing chamber 104e is provided between the horizontally-disposed oil chambers 96a and 98a, the overall size of the engine can be reduced.

Figure 10:
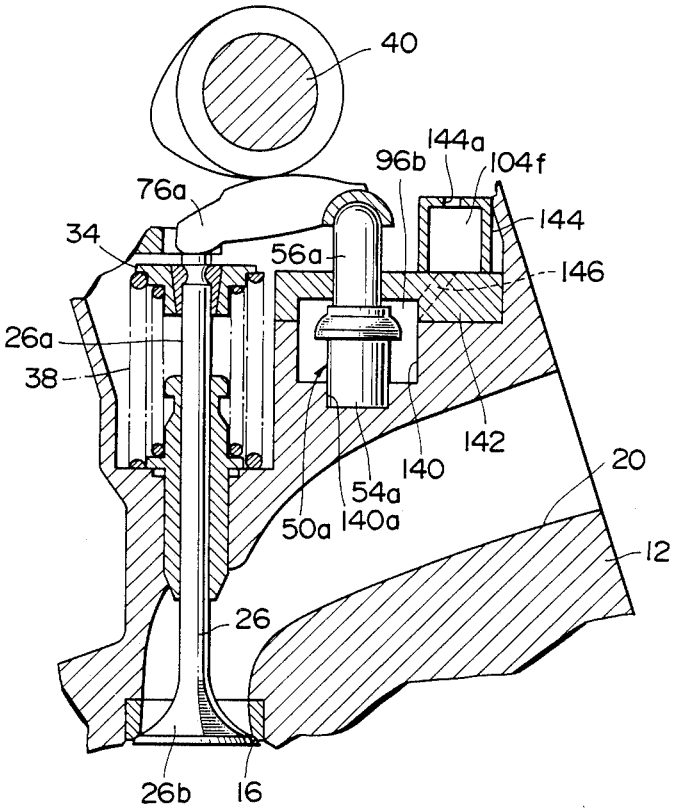
FIG. 10 is a cross-sectional view of a portion of an engine, showing a further modified degassing means.

FIG. 10 shows a further modified valve train applied to an internal combustion engine of the vertical type. A pair of upwardly-opening recesses 140, only one of which is shown in the drawings, are formed in a cylinder head 12. A cover plate 142 is mounted on the cylinder head 12 to cover each recess 140 to form an oil chamber 96b. Although a pair of hydraulic tappets 50a are provided as described above for the above embodiments, only one of the hydraulic tappet 50a for an intake valve 26 and its coacting component parts are shown for illustration purposes. The hydraulic tappet 50a is mounted in the recess 140. A cylinder 54a of the hydraulic tappet 50a is fitted at its lower end in a central depression 140a formed in the bottom of the recess 140. A plunger 56a of the hydraulic tappet 50a slidably extends through the cover plate 142, and is held at one end thereof against one end of a rocker arm 76a. The other end of the rocker arm 76a is held against an upper end of a stem portion 26a of the intake valve 26. A camshaft 40 is held in contact with the rocker arm 76a intermediate the opposite ends thereof. A box 144 is mounted on the cover plate 142, the box 144 defining a degassing chamber 104f. A passageway 146 is formed through the cover plate 142 and communicates the degassing chamber 104f with the oil chamber 96a. The box 144 has an inlet aperture 144a for introducing the oil into the degassing chamber 104f.

What is claimed is:

1. A valve train for an internal combustion engine, the internal combustion engine including a cylinder head having a pair of intake and exhaust ports, said valve train comprising:

(a) a camshaft housing adapted to be mounted on the cylinder head to define a camshaft chamber;

(b) a pair of intake and exhaust valves mounted on the cylinder head so as to be moveable for closing and opening the intake and exhaust ports respectively;

(c) mounting means on the cylinder head disposed within said camshaft, said mounting means comprising a mounting block and an abutment member, said mounting block having a pair of apertures formed therethrough and means for holding oil;

(d) a camshaft mounted within said camshaft chamber for rotation about an axis thereof and disposed between the cylinder head and said mounting means;

(e) a pair of elongated rocker arms interposed between said camshaft and said mounting means, each rocker arm having opposite first and second sides facing said camshaft and said mounting means, respectively, said rockers arm having opposite ends held, respectively, against said camshaft and a respective one of said intake and exhaust valves at said first side of said rocker arm; and (f) a pair of hydraulic tappets mounted on said mounting means, each hydraulic tappet comprising an axially-extendible elongated body slidably extending through a respective one of said pair of apertures formed through said mounting block, a tubular boot of an elastic material disposed within said means for holding oil so as to be soaked in the oil and mounted around an upper end portion of said body so as to form an oil reservoir therebetween, a hydraulic chamber in communication with said oil reservoir so as to be supplied with oil therefrom, means urging said body to extend axially, a check valve for normally interrupting the communication between said oil reservoir and said hydraulic chamber to prevent an axial contraction of said elongated body, each hydraulic tappet being mounted one end in contact with said second side of a respective one of said rocker arms intermediate the opposite ends of said rocker arm, the other end of said hydraulic tappet being held by said mounting means against movement away from said rocker arm, whereby upon rotation of said camshaft, each rocker arm is pivotally moved about said one end of said hydraulic tappet for moving a respective one of said intake and exhaust valves.

2. A valve train according to claim 1, in which said mounting means comprises a mounting block having a pair of apertures formed therethrough which said elongated bodies of the respective hydraulic tappet slidably extend, and a cover plate mounted on said mounting block so as to form an enclosed space therebetween, said boot of each hydraulic tappet being disposed within said enclosed space, said other end of said hydraulic tappet being held against said cover plate.

3. A valve train according to claim 1, in which an annular groove is formed in a surface defining each of said apertures, said mounting block having a pair of oil feed bores formed therein and leading to said annular grooves, respectively, there being provided a source of lubricating oil connected to said bores for supplying lubricating oil to said annular grooves.

4. A valve train according to claim 1, in which said mounting block has a pair of oil chambers within which said boots of the respective hydraulic tappets are disposed, respectively, said mounting block having an oil supply means for supplying oil to said oil chambers.

5. A valve train according to claim 4, in which said oil supply means comprises a hollow portion defining a degassing chamber, said hollow portion having an inlet aperture communicating said camshaft chamber with said degassing chamber for introducing into said degassing chamber oil present in said camshaft chamber, said supplying means further comprising a passageway disposed at a level below said degassing chamber and communicating said degassing chamber with said oil chambers, so that said degassing chamber arrests air bubbles in the oil therein before it is fed to said oil chambers.

6. A valve train according to claim 5, in which said hollow portion has an upper inner surface, said inlet aperture opening to said upper inner surface, said upper inner surface slanting upwardly toward said inlet aperture.

7. A valve train according to claim 5, in which said hollow portion has a generally horizontally-disposed wall dividing said degassing chamber into first and second degassing sections spaced vertically from each other, said wall having a communication aperture formed therethrough to communicate said first and second degassing sections with each other, and said second degassing section communicating with said passageway.

8. A valve train according to claim 7, in which said hollow portion has an upper inner surface and a lower inner surface, said inlet aperture opening to said upper inner surface, said upper inner surface slanting upwardly toward said inlet aperture, said wall having a lower surface slanting upwardly toward said communication aperture, said passageway opening to said lower inner surface of said hollow portion, and said inlet aperture, said communication aperture and that portion of said lower inner surface to which said passageway opens being staggered in a vertical direction.

9. A valve train according to claim 1, in which said means for holding oil comprise separate chambers in communication with each other so that the oil reserved therein can flow therethrough.

* * * * *